US011286869B2

(12) United States Patent
Idogawa et al.

(10) Patent No.: US 11,286,869 B2
(45) Date of Patent: Mar. 29, 2022

(54) ENGINE DEVICE

(71) Applicant: TOYOTA JIDOSHA KABUSHIKI KAISHA, Aichi-ken (JP)

(72) Inventors: Masanao Idogawa, Nagoya (JP); Takahiro Uchida, Okazaki (JP); Masahiro Kachi, Nagakute (JP); Reiko Goh, Toyota (JP); Hirokatsu Yamamoto, Chita (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/242,302

(22) Filed: Apr. 28, 2021

(65) Prior Publication Data

US 2021/0388784 A1 Dec. 16, 2021

(30) Foreign Application Priority Data

Jun. 15, 2020 (JP) ..... JP2020-103237

(51) Int. Cl.
*F02D 41/00* (2006.01)
*F02M 25/08* (2006.01)

(52) U.S. Cl.
CPC ..... *F02D 41/0045* (2013.01); *F02D 41/004* (2013.01); *F02D 41/0007* (2013.01); *F02M 25/089* (2013.01); *F02M 25/0836* (2013.01); *F02D 2200/0406* (2013.01)

(58) Field of Classification Search
CPC ..... F02M 25/08; F02M 25/0836; F02M 25/0872; F02M 25/089; F02M 35/10157; F02M 35/10229; F02D 41/0007; F02D 41/003; F02D 41/0032; F02D 41/004; F02D 41/0045; F02D 2250/41
See application file for complete search history.

(56) References Cited

U.S. PATENT DOCUMENTS 5,005,550 A * 4/1991 Bugin, Jr ..... F02M 25/089 123/520
2013/0104857 A1* 5/2013 Schulz ..... F02M 25/089 123/520
2014/0116399 A1* 5/2014 Ulrey ..... F01M 13/022 123/520

(Continued)

FOREIGN PATENT DOCUMENTS

JP 2014240622 A * 12/2014
JP 2017031936 A * 2/2017
JP 201952561 A 4/2019

*Primary Examiner* — John M Zaleskas
(74) *Attorney, Agent, or Firm* — Hauptman Ham, LLP

(57) ABSTRACT

When a predetermined condition is satisfied, a flow rate ratio of a first passage flow rate to a second passage flow rate is estimated based on a throttle post pressure being a pressure on a downstream side of an intake pipe with respect to a throttle valve and an ejector pressure being a pressure of a suction port of an ejector. The first passage flow rate is a flow rate of an evaporated fuel gas flowing in a first purge passage. The second passage flow rate is a flow rate of the evaporated fuel gas flowing in a second purge passage. The first passage flow rate and the second passage flow rate are estimated based on the flow rate ratio and a valve passing flow rate being a flow rate of the evaporated fuel gas that passes through a purge control value.

5 Claims, 7 Drawing Sheets

(56) References Cited

U.S. PATENT DOCUMENTS

2014/0257672 A1* 9/2014 Surnilla ..... F02D 41/144
701/103
2014/0345574 A1* 11/2014 Haefele ..... F02M 25/0836
123/519
2015/0308310 A1* 10/2015 Pursifull ..... F01M 13/022
123/403
2016/0061124 A1* 3/2016 Pflug ..... F02M 25/089
701/103
2016/0061153 A1* 3/2016 Jeffrey ..... F02M 25/0809
123/520
2016/0069304 A1* 3/2016 Guidi ..... F02M 26/03
123/518
2016/0201612 A1* 7/2016 Pursifull ..... F02D 41/0032
123/520
2016/0201613 A1* 7/2016 Ulrey ..... F02D 41/0032
123/520
2016/0201615 A1* 7/2016 Pursifull ..... F02D 41/0032
123/520
2016/0305352 A1* 10/2016 Pursifull ..... F02D 41/004
2016/0305377 A1* 10/2016 Stefaniak ..... F02M 25/089
2016/0369713 A1* 12/2016 Pursifull ..... F02B 33/44
2016/0369721 A1* 12/2016 Pursifull ..... F02D 41/004
2016/0377038 A1* 12/2016 Bittner ..... F02M 25/089
123/533
2018/0038321 A1* 2/2018 Myers ..... F02M 25/089
2018/0058385 A1* 3/2018 Choi ..... F02M 25/089
2018/0087476 A1* 3/2018 Amemiya ..... F02M 25/0836
2018/0163646 A1* 6/2018 Tsutsumi ..... F02M 35/1038
2018/0171901 A1* 6/2018 Omichi ..... F02M 25/0872
2018/0208054 A1* 7/2018 Guenther ..... F02D 41/221
2018/0223775 A1* 8/2018 Wodausch ..... F02D 41/0087
2019/0040823 A1* 2/2019 Pursifull ..... F02D 41/08
2019/0048830 A1* 2/2019 Akiyama ..... F02M 25/089
2019/0234294 A1* 8/2019 Sager ..... F02D 41/0032
2020/0025156 A1* 1/2020 Mizushima ..... F02D 41/0037
2020/0063672 A1* 2/2020 Wodausch ..... F02D 41/0045
2020/0095957 A1* 3/2020 Hashimoto ..... F02M 25/089
2020/0149486 A1* 5/2020 Tachibana ..... F02M 35/1038
2020/0182198 A1* 6/2020 Eom ..... F02M 25/089
2020/0277904 A1* 9/2020 Pichler ..... F02M 25/089
2020/0291902 A1* 9/2020 Lee ..... F02M 33/02
2020/0318563 A1* 10/2020 Koo ..... F02D 41/0042
2020/0386193 A1* 12/2020 Dudar ..... F02D 13/0203
2021/0148310 A1* 5/2021 Koo ..... F02M 25/0827
2021/0172410 A1* 6/2021 Kim ..... F02M 35/104
2021/0189978 A1* 6/2021 Wanibe ..... F02M 25/089
2021/0317806 A1* 10/2021 Idogawa ..... F02D 41/0045
2021/0340927 A1* 11/2021 Idogawa ..... F02D 41/38

* cited by examiner

ENGINE DEVICE

CROSS-REFERENCE TO RELATED APPLICATION

This application claims priority to Japanese Patent Application No. 2020-103237 filed on Jun. 15, 2020, incorporated herein by reference in its entirety.

BACKGROUND

1. Technical Field

The present disclosure relates to an engine device.

2. Description of Related Art

In the related art, as an engine device of this type, an engine device including a first purge passage, a second purge passage, a supply passage, and a purge control valve is proposed. The first purge passage purges an evaporated fuel gas containing an evaporated fuel to the downstream side of an intake pipe of the engine with respect to a throttle valve. The second purge passage purges the evaporated fuel gas to the upstream side of the intake pipe with respect to of a compressor of a supercharger using an ejector that generates a negative pressure based on a boost pressure from the supercharger. The supply passage supplies the evaporated fuel gas generated in a fuel tank to the first purge passage and the second purge passage. The purge control valve is provided in the supply passage (see, for example, Japanese Unexamined Patent Application Publication No. 2019-052561 (JP 2019-052561 A)). In the engine device above, an intake pipe pressure on the downstream side of the intake pipe with respect to the throttle valve is compared with a pressure generated by the ejector, and which of the first purge passage or the second purge passage is used for purging the evaporated fuel gas is detected.

SUMMARY

In the engine device as described above, there may be a case where the evaporated fuel gas is spontaneously distributed and flow to the first purge passage and the second purge passage due to the pressure on the downstream side of the intake pipe with respect to the throttle valve, etc. In this case, there is a demand for capability to estimate a flow rate of the evaporated fuel gas flowing to each of the first purge passage and the second purge passage.

An object of the engine device according to the present disclosure is to make it possible to estimate the flow rate of the evaporated fuel gas in each of the first purge passage and the second purge passage when the evaporated fuel gas flows to the first purge passage and the second purge passage.

The engine device according to the present disclosure has adopted the following means in order to achieve the main object above.

An engine device according to the present disclosure includes: an engine that includes a throttle valve disposed in an intake pipe and outputs power through explosive combustion in a combustion chamber using a fuel supplied from a fuel tank; a supercharger including a compressor disposed on an upstream side of the intake pipe with respect to the throttle valve; an evaporated fuel processing device including a supply passage that branches into a first purge passage connecting to a downstream side of the intake pipe with respect to the throttle valve and a second purge passage and supplies an evaporated fuel gas containing an evaporated fuel generated in the fuel tank to the intake pipe via the first purge passage and the second purge passage, an ejector having an intake port connecting to a return passage connecting to the intake pipe between the compressor and the throttle valve, an exhaust port connecting to an upstream side of the intake pipe with respect to the compressor, and a suction port connecting to the second purge passage, and a purge control valve provided in the supply passage; and a control device. In the engine device, when a predetermined condition that the evaporated fuel gas that passes through the purge control valve flows to the first purge passage and the second purge passage is satisfied, the control device estimates a flow rate ratio of a first passage flow rate to a second passage flow rate based on a relationship between a throttle post pressure being a pressure on the downstream side of the intake pipe with respect to the throttle valve and an ejector pressure being a pressure of the suction port of the ejector, the first passage flow rate being a flow rate of the evaporated fuel gas flowing in the first purge passage and the second passage flow rate being a flow rate of the evaporated fuel gas flowing in the second purge passage, and estimates the first passage flow rate and the second passage flow rate based on the flow rate ratio and a valve passing flow rate being a flow rate of the evaporated fuel gas that passes through the purge control value.

In the engine device according to the present disclosure, when the predetermined condition that the evaporated fuel gas that passes through the purge control valve flows in the first purge passage and the second purge passage is satisfied, the flow rate ratio of the first passage flow rate to the second passage flow rate is estimated based on the throttle post pressure being a pressure on the downstream side of the intake pipe with respect to the throttle valve and the ejector pressure being a pressure of the suction port of the ejector. The first passage flow rate is a flow rate of the evaporated fuel gas flowing in the first purge passage. The second passage flow rate is a flow rate of the evaporated fuel gas flowing in the second purge passage. The first passage flow rate and the second passage flow rate are estimated based on the flow rate ratio and a valve passing flow rate being a flow rate of the evaporated fuel gas that passes through the purge control value. With the processing above, the first passage flow rate and the second passage flow rate can be estimated more appropriately.

In the engine device according to the present disclosure, when the purge that supplies the evaporated fuel gas to the intake pipe is performed, the control device may control the purge control valve based on a required purge rate and estimate the valve passing flow rate based on an intake air amount and the required purge rate. With the processing above, the valve passing flow rate can be estimated.

In the engine device according to the present disclosure, the control device may set the flow rate ratio such that the first passage flow rate becomes larger as the throttle post pressure becomes smaller (becomes larger as a negative pressure) than the ejector pressure. With the processing above, the flow rate ratio can be estimated more appropriately.

In the engine device according to the present disclosure, when the predetermined condition is satisfied, the control device may estimate the flow rate ratio based on a relationship between the throttle post pressure and the ejector pressure and a relationship between a sectional area of the first purge passage and a sectional area of the second purge passage. With the processing above, the flow rate ratio can be estimated more appropriately.

In the engine device according to the present disclosure, the predetermined condition may include a condition in which the throttle post pressure and the ejector pressure are negative pressures. In this case, in estimation processing in which, when the throttle post pressure is less than a threshold, the control device estimates a purge that supplies the evaporated fuel gas to the intake pipe does not include a second purge that supplies the evaporated fuel gas to the intake pipe via the second purge passage, and when the throttle post pressure is equal to or more than the threshold, the control device estimates that the purge includes the second purge, the control device may continue the estimation that the purge includes the second purge until a predetermined time elapses when the throttle post pressure falls below the threshold from a state of being equal to or more than the threshold, and the predetermined condition may further include a condition in which the control device estimates that the purge includes the second purge. With the processing above, whether the predetermined condition is satisfied can be determined more appropriately.

In the engine device according to the present disclosure, the control device may determine which of a first purge and a second purge is a dominant purge based on the ejector pressure and a value obtained by adding an offset amount based on a sectional area of the second purge passage with respect to a sectional area of the first purge passage to the throttle post pressure, the first purge supplying the evaporated fuel gas to the intake pipe via the first purge passage and the second purge supplying the evaporated fuel gas to the intake pipe via the second purge passage, and the control device may further estimate the flow rate ratio based on the dominant purge when the predetermined condition is not satisfied.

In this case, the control device may determine the dominant purge based on the ejector pressure and the value obtained by adding the offset amount based on the sectional area of the second purge passage with respect to the sectional area of the first purge passage to the throttle post pressure. With the processing above, the dominant purge can be estimated more appropriately. Here, the "sectional area" may be represented by a pipe diameter. In this case, the control device may set the offset amount such that an absolute value of the offset amount as a negative value becomes larger as an absolute value of the throttle post pressure as a negative value becomes larger. This is based on the fact that an influence of the sectional area of the second purge passage with respect to the sectional area of the first purge passage becomes larger as the absolute value of the throttle post pressure as the negative value becomes larger.

In the engine device according to the present disclosure, the control device may estimate the ejector pressure based on a boost pressure that is a pressure in the intake pipe between the compressor and the throttle valve, and a drive duty of the purge control valve. With the processing above, the ejector pressure can be estimated more appropriately.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

Next, modes for carrying out the present disclosure will be described using an embodiment.

Figure 1:
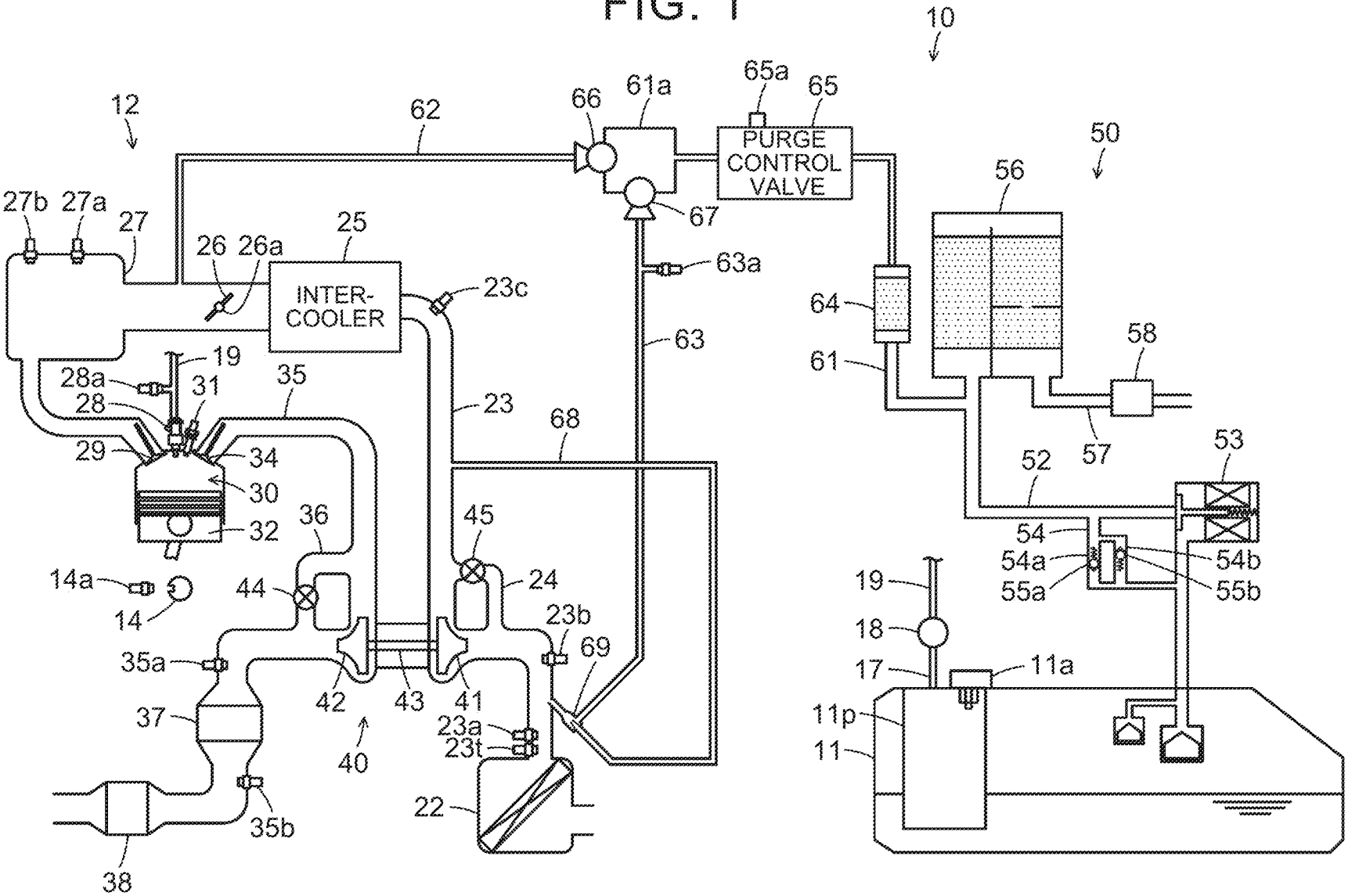
FIG. 1 is a configuration diagram schematically showing a configuration of an engine device 10 according to the present disclosure.
Figure 2:
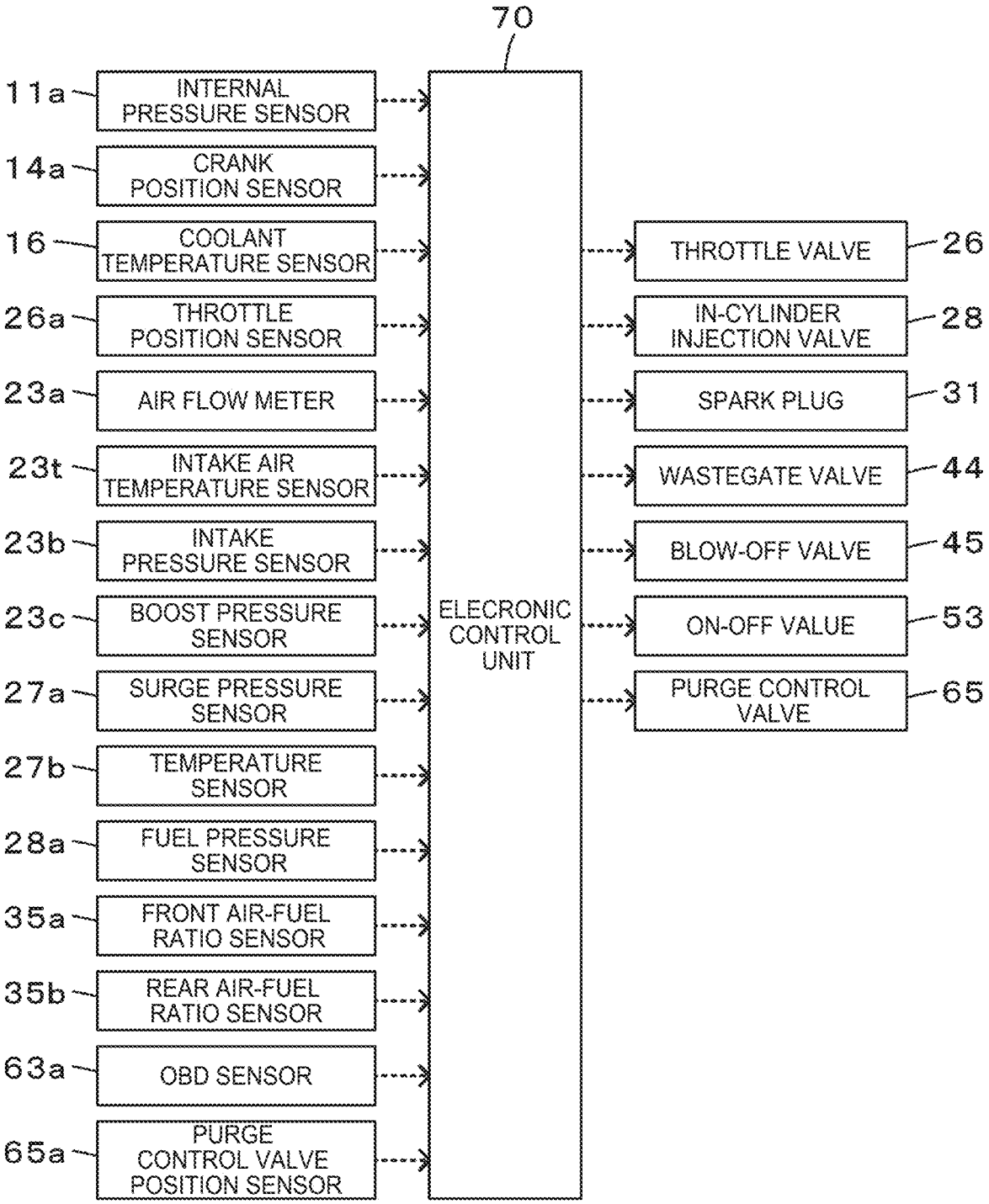
FIG. 2 is an explanatory diagram showing an example of input and output signals to and from an electronic control unit 70.

FIG. 1 is a configuration diagram schematically showing a configuration of an engine device 10 as an embodiment of the present disclosure. FIG. 2 is an explanatory diagram showing an example of input and output signals to and from an electronic control unit 70. An engine device 10 according to the embodiment is mounted on a general vehicle that travels using power from an engine 12 and various types of hybrid vehicles that include a motor in addition to the engine 12. As shown in FIGS. 1 and 2, the engine device 10 includes the engine 12, a supercharger 40, an evaporated fuel processing device 50, and the electronic control unit 70.

The engine 12 is configured as an internal combustion engine that outputs power using fuel such as gasoline or diesel oil supplied from a fuel tank 11. The engine 12 sucks the air cleaned by an air cleaner 22 into an intake pipe 23 and causes the intake air to pass through an intercooler 25, a throttle valve 26, and a surge tank 27 in this order. Subsequently, the fuel is injected from an in-cylinder injection valve 28 attached to a combustion chamber 30 to the air sucked into the combustion chamber 30 via an intake valve 29 to mix the air and the fuel, and the mixture of the air and the fuel is exploded and combusted using an electric spark generated by an spark plug 31. The engine 12 converts a reciprocating motion of a piston 32 that is pushed down into a rotational motion of a crankshaft 14 by an energy generated through the explosive combustion above. An exhaust air discharged from the combustion chamber 30 to an exhaust pipe 35 via an exhaust valve 34 is discharged to the outside air via exhaust control devices 37, 38 including a catalyst (three-way catalyst) that removes harmful components, such as carbon monoxide (CO), hydrocarbon (HC), and nitrogen oxide (NOx). The fuel is supplied to the in-cylinder injection valve 28 from the fuel tank 11 via a feed pump 11*p*, a low-pressure side fuel passage 17, a high-pressure pump 18, and a high-pressure side fuel passage 19. The high-pressure pump 18 is driven by the power from the engine 12 to pressurize the fuel in the low-pressure side fuel passage 17 and supply the pressurized fuel to the high-pressure side fuel passage 19.

The supercharger 40 is configured as a turbocharger, and includes a compressor 41, a turbine 42, a rotary shaft 43, a wastegate valve 44, and a blow-off valve 45. The compressor 41 is disposed on the upstream side of the intake pipe 23 with respect to the intercooler 25. The turbine 42 is disposed on the upstream side of the exhaust pipe 35 with respect to the exhaust control device 37. The rotary shaft 43 connects the compressor 41 and the turbine 42. The wastegate valve 44 is provided in a bypass pipe 36 that connects the upstream side and the downstream side of the exhaust pipe 35 with respect to the turbine 42, and is controlled by the electronic control unit 70. The blow-off valve 45 is provided in a bypass pipe 24 that connects the upstream side and the downstream side of the intake pipe 23 with respect to the compressor 41, and is controlled by the electronic control unit 70.

In the supercharger 40, adjustment of an opening degree of the wastegate valve 44 adjusts a distribution ratio between an amount of the exhaust air flowing in the bypass pipe 36 to an amount of the exhaust air flowing in the turbine 42, adjusts a rotary drive force of the turbine 42, adjusts a compressed air amount by the compressor 41, and adjusts a boost pressure (intake air pressure) of the engine 12. Here, in detail, the distribution ratio is adjusted such that as the opening degree of the wastegate valve 44 becomes smaller, the amount of the exhaust air flowing in the bypass pipe 36 decreases, and the amount of the exhaust air flowing in the turbine 42 increases. When the wastegate valve 44 is fully opened, the engine 12 can operate in the same manner as a naturally aspirated engine without the supercharger 40.

Further, in the supercharger 40, when the pressure on the downstream side of the intake pipe 23 with respect to the compressor 41 is higher to a certain extent than the pressure on the upstream side, a surplus pressure on the downstream side with respect to the compressor 41 can be released by opening the blow-off valve 45. The blow-off valve 45 may be configured as a check valve that opens when the pressure on the downstream side of the intake pipe 23 becomes higher to a certain extent than the pressure on the upstream side of the intake pipe 23 with respect to the compressor 41, in place of a valve controlled by the electronic control unit 70.

The evaporated fuel processing device 50 is a device for purging an evaporated fuel gas (purge gas) generated in the fuel tank 11 to the intake pipe 23 of the engine 12. The evaporated fuel processing device 50 includes an introduction passage 52, an on-off valve 53, and a bypass passage 54, relief valves 55*a*, 55*b*, a canister 56, a common passage 61, a first purge passage 62, a second purge passage 63, a buffer portion 64, a purge control valve 65, check valves 66, 67, a return passage 68, and an ejector 69. The introduction passage 52 and the common passage 61 correspond to a "supply passage" according to the embodiment.

The introduction passage 52 is connected to the fuel tank 11 and the canister 56. The on-off valve 53 is provided in the introduction passage 52, and is configured as a normally closed type solenoid valve. The on-off valve 53 is controlled by the electronic control unit 70.

The bypass passage 54 bypasses the fuel tank 11 side and the canister 56 side of the introduction passage 52 with respect to the on-off valve 53 and includes branch portions 54*a*, 54*b* that are two passages branching from the bypass passage 54 and merge into one. The relief valve 55*a* is provided in the branch portion Ma and is configured as a check valve. The relief valve 55*a* opens when the pressure on the fuel tank 11 side becomes higher to a certain extent than the pressure on the canister 56 side. The relief valve 55*b* is provided in the branch portion 54*b* and is configured as a check valve. The relief valve 55*b* opens when the pressure on the canister 56 side becomes higher to a certain extent than the pressure on the fuel tank 11 side.

The canister 56 is connected to the introduction passage 52 and is open to the atmosphere through an atmosphere opening passage 57. An adsorbent such as activated carbon capable of adsorbing the evaporated fuel from the fuel tank 11, for example, is charged inside the canister 56. An air filter 58 is provided in the atmosphere opening passage 57.

The common passage 61 is connected to the introduction passage 52 in the vicinity of the canister 56, and branches into the first purge passage 62 and the second purge passage 63 at a branch point 61*a*. The first purge passage 62 is connected to the intake pipe 23 between the throttle valve 26 and the surge tank 27. The second purge passage 63 is connected to a suction port of the ejector 69.

The buffer portion 64 is provided in the common passage 61. An adsorbent such as activated carbon capable of adsorbing the evaporated fuel from the fuel tank 11 and the canister 56, for example, is charged inside the buffer portion 64. The purge control valve 65 is provided on the branch point 61*a* side of the common passage 61 with respect to the buffer portion 64. The purge control valve 65 is configured as a normally closed type solenoid valve. The purge control valve 65 is controlled by the electronic control unit 70.

The check valve 66 is provided in the first purge passage 62 in the vicinity of the branch point 61*a*. The check valve 66 allows the evaporated fuel gas (purge gas) containing the evaporated fuel to flow in a direction from the common passage 61 to the first purge passage 62 (on the intake pipe 23 side) in the purge passage 60 and prohibits the evaporated fuel to flow in a reverse direction to the above. The check valve 67 is provided in the second purge passage 63 in the vicinity of the branch point 61*a*. The check valve 67 allows a flow of the evaporated fuel gas in a direction from the common passage 61 to the second purge passage 63 (on the ejector 69 side) in the purge passage 60 and prohibits a flow of the evaporated fuel from in a reverse direction to the above.

The return passage 68 is connected to the intake pipe 23 between the compressor 41 and the intercooler 25, and connected to an intake port of the ejector 69. The ejector 69 has the intake port, the suction port, and an exhaust port. The intake port of the ejector 69 is connected to the return passage 68. The suction port is connected to the second purge passage 63. The exhaust port is connected to the upstream side of the intake pipe 23 with respect to the compressor 41. A tip portion of the intake port is tapered.

In the ejector 69, when the supercharger 40 is operating (when the pressure in the intake pipe 23 between the compressor 41 and the intercooler 25 is a positive pressure), a pressure difference occurs between the intake port and the exhaust port, and a return intake air (intake air returning from the downstream side of the intake pipe 23 with respect to the compressor 41 via the return passage 68) flows from the intake port to the exhaust port. At this time, the return intake air is decompressed in the tip portion of the intake port, and a negative pressure is generated around the tip portion. Subsequently, due to the negative pressure, the evaporated fuel gas is sucked from the second purge passage 63 through the suction port, and the evaporated fuel gas supplied to the upstream side of the intake pipe 23 with respect to the compressor 41 through the exhaust port, along with the return intake air at the negative pressure.

The evaporated fuel processing device 50 configured as described above basically operates as follows. When the pressure on the downstream side of the intake pipe 23 with respect to the throttle valve 26 (surge pressure Ps that will be described later) is a negative pressure and the on-off valve 53 and the purge control valve 65 are open, the check valve 66 is opened, and the evaporated fuel gas (purge gas) generated in the fuel tank 11 and the evaporated fuel gas desorbed from the canister 56 are supplied to the downstream side of the intake pipe 23 with respect to the throttle valve 26 via the introduction passage 52, the common passage 61, and the first purge passage 62. The purge above will be hereinafter referred to as a "downstream purge". At this time, when the pressure in the intake pipe 23 between the compressor 41 and the intercooler 25 (boost pressure Pc that will be described later) is a negative pressure or zero, the ejector 69 does not operate, and the check valve 66 is thus not opened.

Further, when the pressure (the boost pressure Pc) in the intake pipe 23 between the compressor 41 and the intercooler 25 is a positive pressure and the on-off valve 53 and the purge control valve 65 are open, the ejector 69 operates and the check valve 67 is opened, and the evaporated fuel gas is supplied to the upstream side of the intake pipe 23 with respect to the compressor 41 through the introduction passage 52, the common passage 61, the second purge passage 63, and the ejector 69. The purge above will be hereinafter referred to as an "upstream purge". At this time, the check valve 66 is opened or closed in accordance with the pressure (surge pressure Ps) on the downstream side of the intake pipe 23 with respect to the throttle valve 26.

Therefore, in the evaporated fuel processing device 50, of the downstream purge and the upstream purge, only the downstream purge is performed, only the upstream purge is performed, or both of the downstream purge and the upstream purge are performed in accordance with the pressure (the surge pressure Ps) on the downstream side of intake pipe 23 with respect to the throttle valve 26 and the pressure (the boost pressure Pc) in the intake pipe 23 between the compressor 41 and the intercooler 25.

The electronic control unit 70 is configured as a microprocessor centered on a central processing unit (CPU), and includes a read-only memory (ROM) that stores a processing program, a random access memory (RAM) that temporarily stores data, and a non-volatile flash memory that stores and retains data, an input-output port, and a communication port, in addition to the CPU. Signals from various sensors are input to the electronic control unit 70 via the input port.

Examples of the signals input to the electronic control unit 70 include, for example, a tank internal pressure Ptnk from an internal pressure sensor 11*a* that detects a pressure in the fuel tank 11, a crank angle θcr from a crank position sensor 14*a* that detects a rotational position of the crankshaft 14 of the engine 12, a coolant temperature Tw from a coolant temperature sensor 16 that detects a temperature of coolant in the engine 12, and a throttle opening degree TH from a throttle position sensor 26*a* that detects an opening degree of the throttle valve 26. The examples of the signals also include a cam position θca from a cam position sensor (not shown) that detects a rotational position of an intake camshaft that opens and closes the intake valve 29 and an exhaust cam shaft that opens and closes the exhaust valve 34. The examples of the signals also include an intake air amount Qa from an air flow meter 23*a* installed on the upstream side of the intake pipe 23 with respect to the compressor 41, an intake air temperature Tin from an intake air temperature sensor 23*t* installed on the upstream side of the intake pipe 23 with respect to the compressor 41, an intake pressure (compressor fore pressure) Pin from an intake pressure sensor 23*b* installed on the upstream side of the intake pipe 23 with respect to the compressor 41, and the boost pressure Pc from a boost pressure sensor 23*c* installed in the intake pipe 23 between the compressor 41 and the intercooler 25. The examples of the signals also include the surge pressure (throttle post pressure) Ps from a surge pressure sensor 27*a* attached to the surge tank 27 and a surge temperature Ts from a temperature sensor 27*b* attached to the surge tank 27. The examples of the signals also include a supply fuel pressure Pfd from a fuel pressure sensor 28*a* that detects a fuel pressure of the fuel supplied to the in-cylinder injection valve 28. The examples of the signals also include a front air-fuel ratio AF1 from a front air-fuel ratio sensor 35*a* installed on the upstream side of the exhaust pipe 35 with respect to the exhaust control device 37 and a rear air-fuel AF2 from a rear air-fuel ratio sensor 35*b* installed in the exhaust pipe 35 between the exhaust control device 37 and the exhaust control device 38. The examples of the signals also include an opening degree Opv of the purge control valve 65 from a purge control valve position sensor 65*a* and a sensor signal Pobd from an OBD sensor (pressure sensor) 63*a* installed in the second purge passage 63.

Various types of control signals are output from the electronic control unit 70 via the output port. Examples of the signals output from the electronic control unit 70 include a control signal to the throttle valve 26, a control signal to the in-cylinder injection valve 28, and a control signal to the spark plug 31. The examples of the signals also include a control signal to the wastegate valve 44, a control signal to the blow-off valve 45, and a control signal to the on-off valve 53. The examples of the signals also include a control signal to the purge control valve 65.

The electronic control unit 70 calculates an engine speed Ne and a load factor (a ratio of a volume of the air actually sucked in one cycle to a stroke volume per cycle of the engine 12) KL of the engine 12. The engine speed Ne is calculated based on the crank angle θcr from the crank position sensor 14*a*. The load factor KL is calculated based on the intake air amount Qa from the air flow meter 23*a* and the engine speed Ne.

In the engine device 10 according to the embodiment configured as described above, the electronic control unit 70 executes intake air amount control that controls the opening degree of the throttle valve 26, fuel injection control that controls a fuel injection amount from the in-cylinder injection valve 28, ignition control that controls an ignition timing of the spark plug 31, boost control that controls the opening degree of the wastegate valve 44, and purge control that controls the opening degree of the purge control valve 65, etc., based on a required load factor KL* of the engine 12.

In the intake air amount control, the throttle valve 26 is controlled such that the throttle opening degree TH becomes smaller as the flow rate (purge flow rate) of the evaporated fuel gas supplied to the intake pipe 23 becomes larger in accordance with the purge control. In the fuel injection control, the in-cylinder injection valve 28 is controlled such that the fuel injection amount becomes smaller as the purge flow rate supplied to the combustion chamber 30 in accordance with the purge control becomes larger (the front air-fuel ratio AF1 becomes richer in accordance with this). The purge control is executed when a purge condition is satisfied. As the purge condition, for example, a condition in which operation control of the engine 12 (e.g. the fuel injection control) is executed and the coolant temperature Tw is equal to or higher than a threshold Twref is used. The threshold Twref, for example, takes a value within the range of about 55° C. to 65° C. In the purge control, the purge control valve 65 is controlled using a drive duty Ddr based on a required purge rate Rprq. The "purge rate" means a ratio of an evaporated fuel gas amount to the intake air amount. The required purge rate Rprq is set such that, within a range being less than a full open purge rate Rpmax that is a purge rate when the drive duty of the purge control valve 65 is 100%, the required purge rate Rprq becomes gradually larger as a duration in which the purge condition is satisfied from a start purge rate Rpst1 or a restart purge rate Rpst2 becomes longer. For the start purge rate Rpst1 and the restart purge rate Rpst2, relatively small values are used as the required purge rate Rprq immediately after the purge condition is switched from a state where the purge condition is not satisfied to a state where the purge condition is satisfied after the first time or the second time with the current trip. Satisfaction of the purge condition is interrupted, for example, when the accelerator is turned off while a vehicle on which the engine device 10 is mounted is traveling and fuel supply to the engine 12 is cut off (when the operation control of the engine 12 is suspended).

Figure 3:
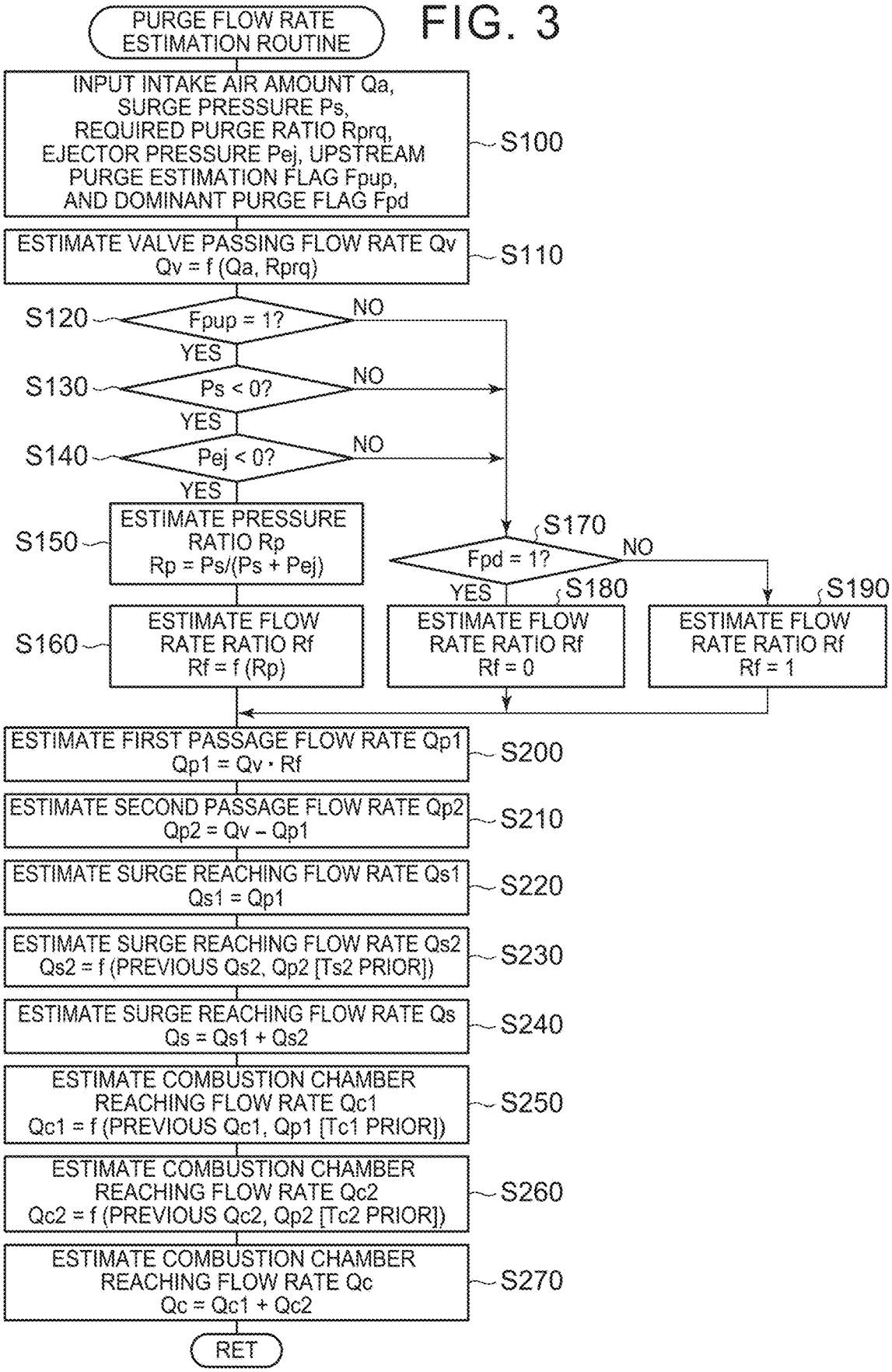
FIG. 3 is a flowchart showing an example of a purge flow rate estimation routine.
Figure 4:
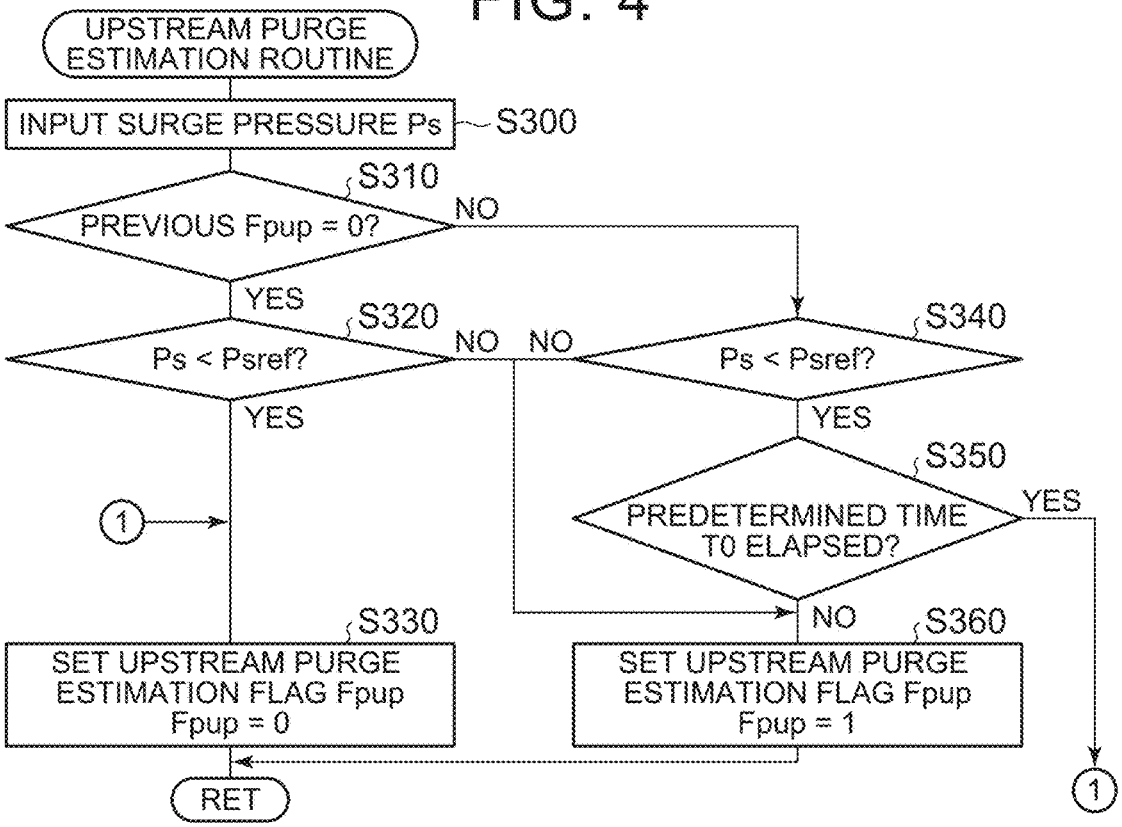
FIG. 4 is a flowchart showing an example of an upstream purge flow rate estimation routine.
Figure 5:
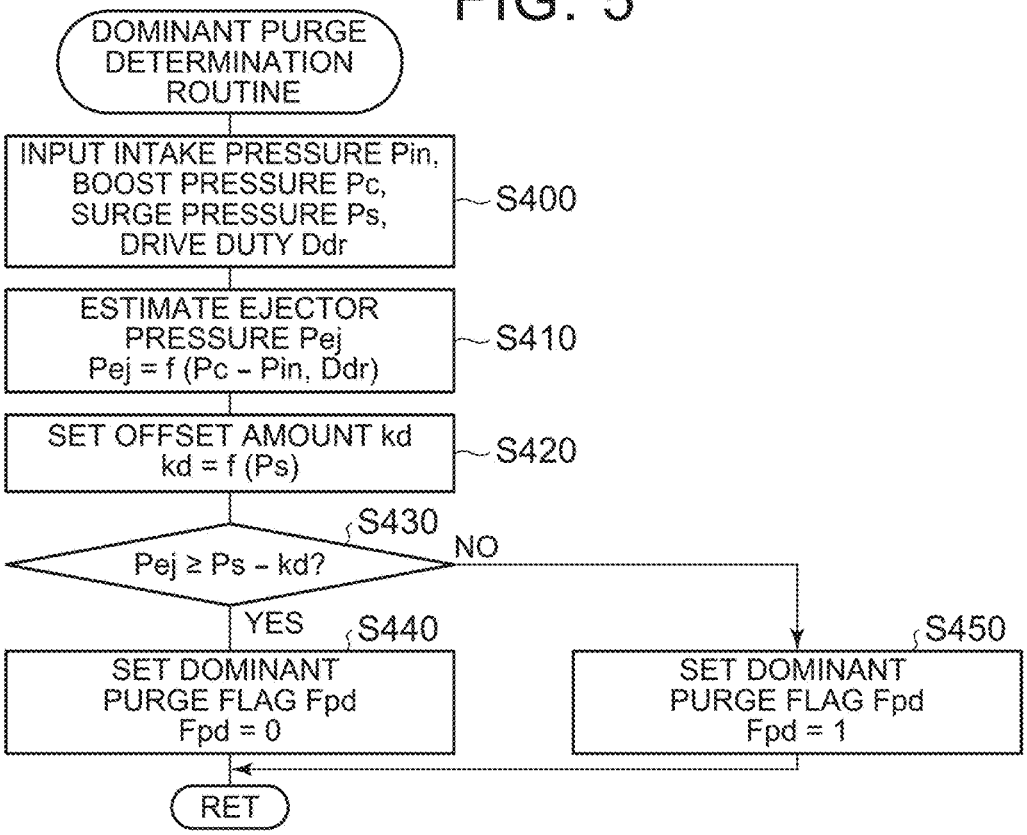
FIG. 5 is a flowchart showing an example of a dominant purge determination routine.

Next, operations of the engine device 10 according to the embodiment configured as described above, particularly operations when the flow rate (the purge flow rate) of the evaporated fuel gas at each position of the engine device 10 (the purge control valve 65, the combustion chamber 30, the surge tank 27) is estimated will be described. FIG. 3 is a flowchart showing an example of a purge flow rate estimation routine. FIG. 4 is a flowchart showing an example of an upstream purge estimation routine for estimating whether the purge includes the upstream purge. FIG. 5 is a flowchart showing an example of a dominant purge determination routine for determining which of the downstream purge and the upstream purge is a dominant purge. The term "the purge includes the upstream purge" means that at least a part of the evaporated fuel gas supplied to the combustion chamber 30 is the evaporated fuel gas supplied via the second purge passage 63. Results of executing the routines shown in FIGS. 4 and 5 are used in the routine shown in FIG. 3. The routines in FIGS. 3 and 5 are repeatedly executed by the electronic control unit 70 when the purge is being executed. The routine in FIG. 4 is repeatedly executed regardless of whether the purge is executed. Hereinafter, for ease of explanation, the estimation of whether the purge includes the upstream purge will be described using the upstream purge estimation routine shown in FIG. 4. The determination of the dominant purge will be described using the dominant purge determination routine shown in FIG. 5. After that, the estimation of the purge flow rate based on the execution results of the routines above will be described using the purge flow rate estimation routine shown in FIG. 3.

The estimation of whether the purge includes the upstream purge will be described using the upstream purge estimation routine shown in FIG. 4. When the upstream purge estimation routine is executed, the electronic control unit 70 first inputs the surge pressure Ps (step S300). Here, a value detected by the surge pressure sensor 27*a* is input as the surge pressure Ps. Subsequently, the electronic control unit 70 checks the value of an upstream purge estimation flag (previous Fpup) set when the routine is executed last time (step S310). Here, the upstream purge estimation flag Fpup is set to 1 when the electronic control unit 70 estimates that the purge includes the upstream purge, and is set to 0 when the electronic control unit 70 estimates that the purge does not include the upstream purge (only the downstream purge). Further, the upstream purge estimation flag Fpup is set to 0 as an initial value when the current trip is started. According to the embodiment, the routine is repeatedly executed regardless of whether the purge condition is satisfied. Therefore, the upstream purge estimation flag Fpup when the purge is not executed is a value on assumption that the purge is executed.

When the previous upstream purge estimation flag (previous Fpup) is 0, that is, when the electronic control unit 70 estimates that the purge does not include the upstream purge (only the downstream purge), the electronic control unit 70 compares the surge pressure Ps with a threshold Psref (step S320). Here, the threshold Psref is a threshold used for estimating whether the purge includes the upstream purge, and is determined in advance through an experiment or analysis. The threshold Psref, for example, takes a value within the range of about −6 to −9 kPa.

When the electronic control unit 70 determines in step S320 that the surge pressure Ps is less than the threshold Psref, the electronic control unit 70 estimates that the purge does not include the upstream purge, and the upstream purge estimation flag Fpup is set to 0, that is, held at 0 (step S330). The routine then ends. When the electronic control unit 70 determines in step S320 that the surge pressure Ps is equal to or more than the threshold Psref, the electronic control unit 70 estimates that the purge includes the upstream purge, and the upstream purge estimation flag Fpup is set to 1, that is, switched from 0 to 1 (step S360). The routine then ends.

When the previous upstream purge estimation flag (previous Fpup) is 1 in step S310, that is, when the electronic control unit 70 estimates that the purge includes the upstream purge, the electronic control unit 70 compares the surge pressure Ps with the threshold Psref (step S340). When the electronic control unit 70 determines that the surge pressure Ps is equal to more than the threshold Psref, the electronic control unit 70 estimates that the purge includes the upstream purge, and the upstream purge estimation flag Fpup is set to 1, that is, held at 1 (step S360). The routine then ends.

When the electronic control unit 70 determines in step S340 that the surge pressure Ps is less than the threshold Psref, the electronic control unit 70 determines whether a predetermined time TO has elapsed after the surge pressure Ps reaches the threshold Psref (step S350). The details of the predetermined time TO will be described later. When the electronic control unit 70 determines that the predetermined time TO has not elapsed after the surge pressure Ps reaches the threshold Psref, the electronic control unit 70 estimates that the purge includes the upstream purge, and the upstream purge estimation flag Fpup is set to 1, that is, held at 1 (step S360). The routine then ends. When the electronic control unit 70 determines that the predetermined time TO has elapsed after the surge pressure Ps reaches the threshold Psref, the electronic control unit 70 estimates that the purge does not include the upstream purge, and the upstream purge estimation flag Fpup is set to 0, that is, switched from 1 to 0 (step S330). The routine then ends.

The predetermined time TO is determined, through an experiment or analysis, as a difference between a time required for the evaporated fuel gas to reach the surge tank 27 (the combustion chamber 30) during the upstream purge and a time required for the evaporated fuel gas to reach the surge tank 27 (the combustion chamber 30) during the downstream purge. A passage volume until the evaporated fuel gas reaches the surge tank 27 (the combustion chamber 30) via the second purge passage 63 and the intake pipe 23 during the upstream purge (a passage volume based on substantially the entire second purge passage 63 and intake pipe 23) is larger than a passage volume until the evaporated fuel gas reaches the surge tank 27 (the combustion chamber 30) via the first purge passage 62 and the intake pipe 23 (a passage volume based on the first purge passage 62 and a portion of the intake pipe 23 on the downstream side with respect to the throttle valve 26). Therefore, the time for the evaporated fuel gas to reach the surge tank 27 (the combustion chamber 30) during the upstream purge is longer than the time for the evaporated fuel gas to reach the surge tank 27 (the combustion chamber 30) during the downstream purge. Accordingly, when the surge pressure Ps falls below the threshold Psref from a state of being equal to or more than the threshold Psref, it is assumed that the evaporated fuel gas remaining in the second purge passage 63 and the evaporated fuel gas newly supplied to the first purge passage 62 merge on the downstream side of the intake pipe 23 with respect to the throttle valve 26 and are supplied to the surge tank 27 (the combustion chamber 30) for a certain time. According to the embodiment, on the assumption above, when the upstream purge estimation flag Fpup is 1, the upstream purge estimation flag Fpup is switched to 0 after the predetermined time TO has elapsed after the surge pressure Ps falls below the threshold Psref from the state of being equal to or more than the threshold Psref. This makes it possible to estimate whether the purge includes the upper purge more appropriately.

Figure 6:
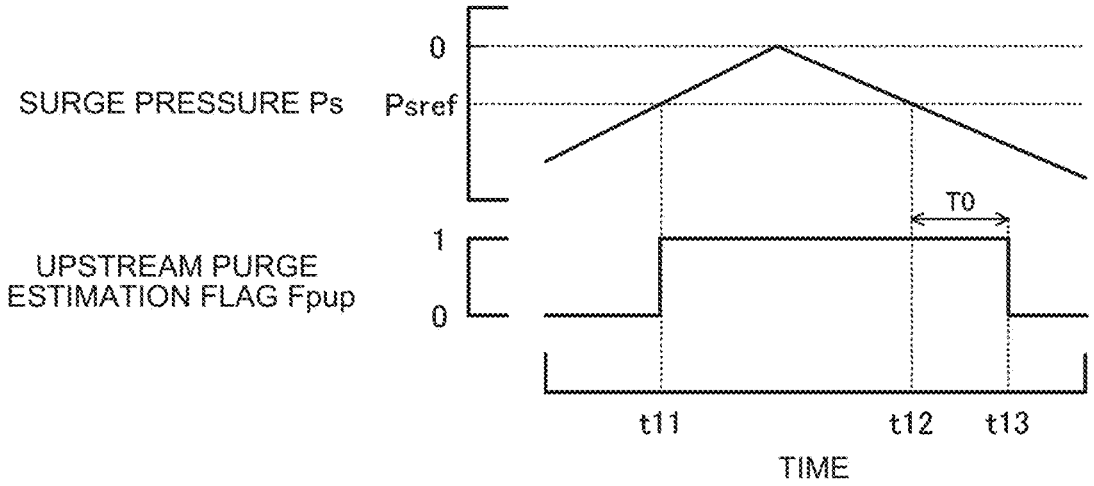
FIG. 6 is an explanatory diagram showing an example of states of a surge pressure Ps and an upstream purge estimation flag Fpup.

FIG. 6 is an explanatory diagram showing an example of states of the surge pressure Ps and the upstream purge estimation flag Fpup. As shown in FIG. 6, when the upstream purge estimation flag Fpup is 0 and the surge pressure Ps reaches the threshold Psref or more (time t11), the upstream purge estimation flag Fpup is switched to 1. After that, when the surge pressure Ps falls below the threshold Psref (time t12), and the predetermined time TO has elapsed while the surge pressure PS is less than the threshold Psref (time t13), the upstream purge estimation flag Fpup is switched to 0.

Next, the determination of the dominant purge will be described using the dominant purge determination routine shown in FIG. 5. When the dominant purge determination routine is executed, the electronic control unit 70 first inputs data such as the intake pressure Pin, the boost pressure Pc, the surge pressure Ps, and the drive duty Ddr (step S400). Here, a value detected by the intake pressure sensor 23*b* is input as the intake pressure Pin. A value detected by the boost pressure sensor 23*c* is input as the boost pressure Pc. A value detected by the surge pressure sensor 27*a* is input as the surge pressure Ps. A value set in the purge control above is input as the drive duty Ddr.

Figure 7:
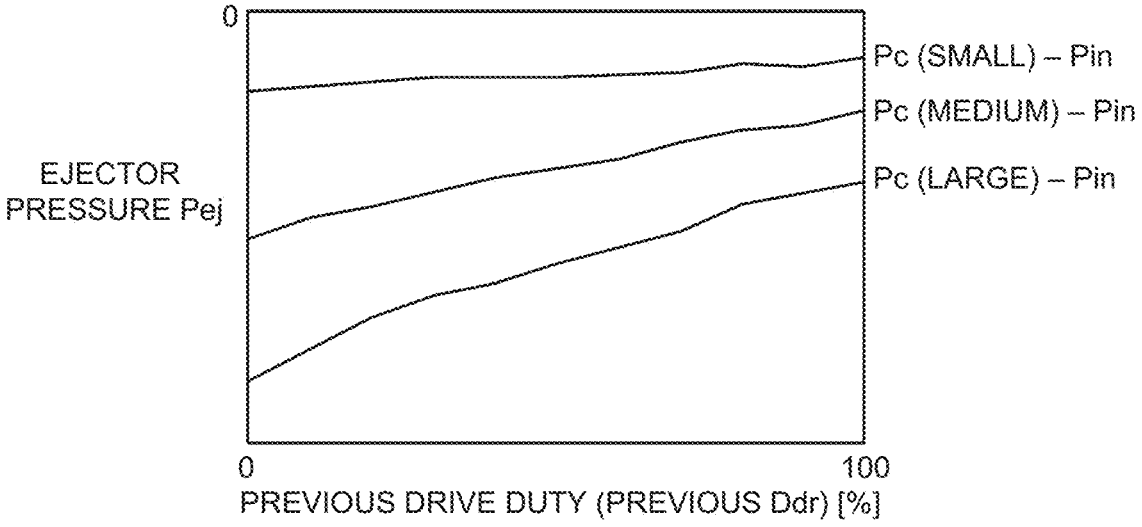
FIG. 7 is an explanatory diagram showing an example of an ejector pressure setting map.

When the data is input as described above, the electronic control unit 70 estimates an ejector pressure Pej based on a value obtained by subtracting the intake pressure Pin from the boost pressure Pc, and the drive duty Ddr (step S410). Here, the ejector pressure Pej can be obtained by applying the value obtained by subtracting the intake pressure Pin from the boost pressure Pc and the drive duty Ddr to an ejector pressure setting map. The ejector pressure setting map is determined in advance, through an experiment and analysis, as a relationship among the value obtained by subtracting the intake pressure Pin from the boost pressure Pc, the drive duty Ddr, and the ejector pressure Pej. The ejector pressure setting map is stored in a ROM or flash memory (both not shown). FIG. 7 is an explanatory diagram showing an example of the ejector pressure setting map. As shown in FIG. 7, the ejector pressure Pej is set so as to become larger as the drive duty Ddr become larger (the absolute value as a negative value becomes smaller) and to become smaller as the boost pressure Pc (the value obtained by subtracting the intake pressure Pin from the boost pressure Pc) becomes larger (the absolute value as a negative value becomes larger).

Figure 8:
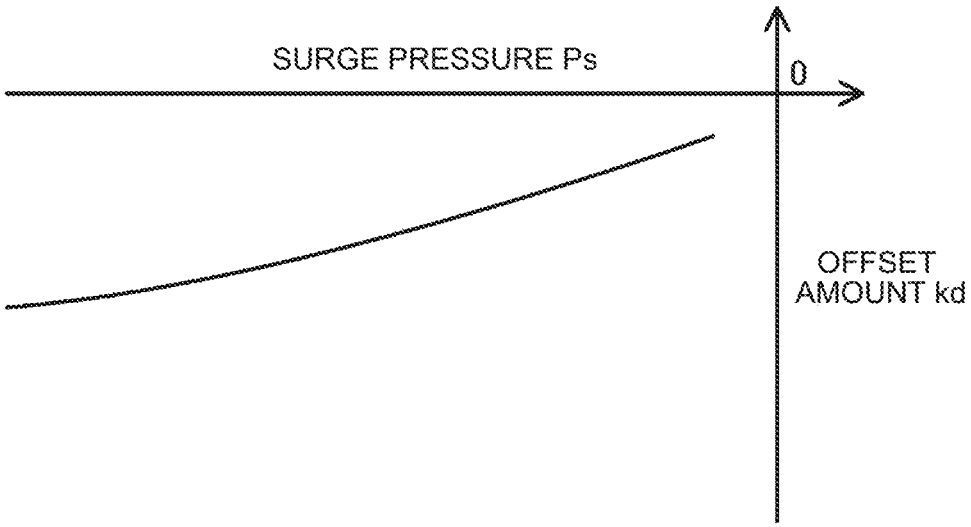
FIG. 8 is an explanatory diagram showing an example of an offset amount setting map when a sectional area of a second purge passage 63 is smaller as compared with a sectional area of a first purge passage 62.

Subsequently, based on the surge pressure Ps, an offset amount kd for offsetting the surge pressure Ps is set to correct an influence based on the sectional area of the second purge passage 63 with respect to the sectional area of the first purge passage 62 (step S420). Here, the offset amount kd can be obtained by applying the surge pressure Ps to an offset amount setting map. The offset amount setting map is determined in advance, through an experiment or analysis, as a relationship between the surge pressure Ps and the offset amount kd. The offset amount setting map is stored in a ROM or flash memory (both not shown). FIG. 8 is an explanatory diagram showing an example of the offset amount setting map when the sectional area of the second purge passage 63 is smaller as compared with the sectional area of the first purge passage 62. As shown in FIG. 8, the offset amount kd is set such that the absolute value of the offset amount kd as a negative value becomes larger as the absolute value of the surge pressure Ps as a negative value becomes larger. The setting above is based on the fact that an influence based on the sectional area of the second purge passage 63 with respect to the sectional area of the first purge passage 62 becomes larger as the absolute value of the surge pressure Ps as a negative value becomes larger. When the first purge passage 62 and the second purge passage 63 are composed of pipes, the sectional area is proportional to the square of a pipe diameter. Therefore, the influence based on the sectional area of the second purge passage 63 with respect to the sectional area of the first purge passage 62 can be regarded as an influence based on the pipe diameter of the second purge passage 63 with respect to the pipe diameter of the first purge passage 62.

When the offset amount kd is set as described above, the electronic control unit 70 compares the ejector pressure Pej with a value obtained by subtracting the offset amount kd from the surge pressure Ps (step S430). When the electronic control unit 70 determines that the ejector pressure Pej is equal to or more than the value obtained by subtracting the offset amount kd from the surge pressure Ps (the absolute value as a negative value is equal to or less than the value), the electronic control unit 70 determines that the evaporated fuel gas dominantly flows in the first purge passage 62 (that the dominant purge is the downstream purge), and a dominant purge flag Fpd is set to 0 (step S440). The routine then ends.

When the electronic control unit 70 determines in step S430 that the ejector pressure Pej is less than the value obtained by subtracting the offset amount kd from the surge pressure Ps (the absolute value as a negative value is larger than the value), the electronic control unit 70 determines that the evaporated fuel gas dominantly flows in the second purge passage 63 (that the dominant purge is the upstream purge), and the dominant purge flag Fpd is set to 1 (step S450). The routine then ends.

According to the embodiment, as described above, the electronic control unit 70 sets the offset amount kd for correcting the influence based on the sectional area of the second purge passage 63 with respect to the sectional area of the first purge passage 62 based on the surge pressure Ps, and determines which of the downstream purge and the upstream purge is the dominant purge by comparing the ejector pressure Pej with the value obtained by subtracting the offset amount kd from the surge pressure Ps. With the processing above, the electronic control unit 70 can determine which of the downstream purge and the upstream purge is the dominant purge more appropriately, as compared with the case where the influence of the sectional area of the second purge passage 63 with respect to the sectional area of the first purge passage 62 is not considered.

Next, the estimation of the purge flow rate will be described using the purge flow rate estimation routine shown in FIG. 3. When the purge flow rate estimation routine is executed, the electronic control unit 70 first inputs data such as the intake air amount Qa, the surge pressure Ps, the required purge rate Rprq, the ejector pressure Pej, the upstream purge estimation flag Fpup, and the dominant purge flag Fpd (step S100). Here, the value detected by the air flow meter 23*a* is input as the intake air amount Qa. A value detected by the surge pressure sensor 27*a* is input as the surge pressure Ps. The value set in the purge control above is input as the required purge rate Rprq. The value set in the upstream purge estimation routine shown in FIG. 4 is input as the upstream purge estimation flag Fpup. The value set in the dominant purge determination routine shown in FIG. 5 is set as the dominant purge flag Fpd.

When the data is input as described above, the electronic control unit 70 estimates a valve passing flow rate Qv based on the intake air amount Qa and the required purge rate Rprq (step S110). The valve passing flow rate Qv is a flow rate (purge flow rate) of the evaporated fuel gas that has passed through the purge control valve 65. Here, the valve passing flow rate Qv can be obtained by applying the intake air amount Qa and the required purge rate Rprq to a valve passing flow rate estimation map. The valve passing flow rate estimation map is determined, through an experiment and analysis, as a relationship between the intake air amount Qa and the required purge rate Rprq, and the valve passing flow rate Qv. The valve passing flow rate estimation map is stored in a ROM or flash memory (both not shown).

Subsequently, the electronic control unit 70 determines whether the upstream purge estimation flag Fpup is 1, that is, whether the electronic control unit 70 estimates that the purge includes the upstream purge (step S120), determines whether the surge pressure Ps is a negative pressure (step S130), and determines whether the ejector pressure Pej is a negative pressure (step S140). The processing in steps S120 to S140 is processing to determine (estimate) the evaporated fuel gas that has passed through the purge control valve 65 (is spontaneously distributed and) flows to the first purge passage 62 and the second purge passage 63, or flows only in either of the first purge passage 62 and the second purge passage 63.

When the electronic control unit 70 determines in step S120 that the upstream purge estimation flag Fpup is 1, that is, the electronic control unit 70 estimates that the purge includes the upstream purge, determines in step S130 that the surge pressure Ps is a negative pressure, and determines in step S140 that the ejector pressure Pej is a negative pressure, the electronic control unit 70 determines (estimates) that the evaporated fuel gas that has passed through the purge control valve 65 flows into the first purge passage 62 and the second purge passage 63. At this time, the electronic control unit 70 calculates a pressure ratio Rp as a ratio of the surge pressure Ps to a sum of the surge pressure Ps and the ejector pressure Pej (step S150), and estimates a flow rate ratio Rf based on the calculated pressure ratio Rp and a relationship between the sectional area of the first purge passage 62 and the sectional area of the second purge passage 63 (step S160). Subsequently, the electronic control unit 70 estimates a value obtained by multiplying the valve passing flow rate Qv by the flow rate ratio Rf as a first passage flow rate Qp1 (step S200), and estimates a value obtained by subtracting the first passage flow rate Qp1 from the valve passing flow rate Qv as a second passage flow rate Qp2 (step S210).

Figure 9:
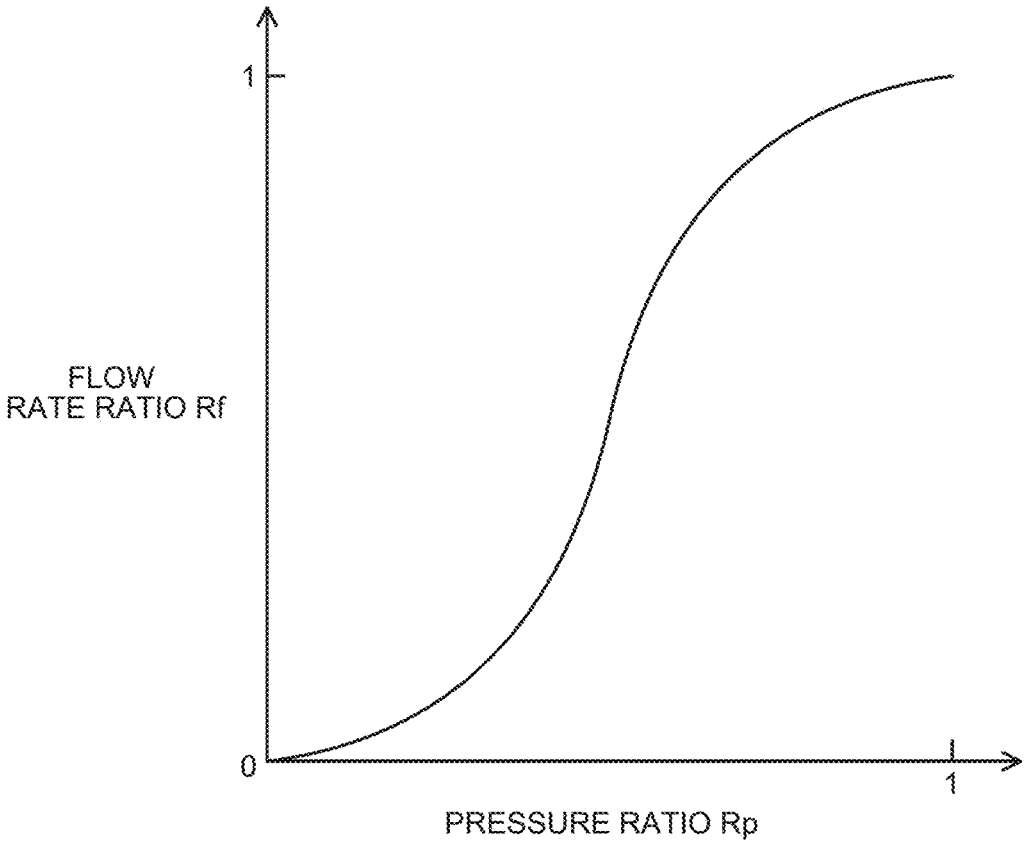
FIG. 9 is an explanatory diagram showing an example of a flow rate ratio estimation map when the sectional area of the first purge passage 62 and the sectional area of the second purge passage 63 have a certain relationship.

Here, the first passage flow rate Qp1 and the second passage flow rate Qp2 are flows rates of the evaporated fuel gas flowing to the first purge passage 62 and the second purge passage 63, respectively, of the evaporated fuel gas that has passed through the purge control valve 65. The flow rate ratio Rf is a ratio of the first passage flow rate Qp1 to the valve passing flow rate Qv (a sum of the first passage flow rate Qp1 and the second passage flow rate Qp2). In the processing in step S160, the flow rate ratio Rf can be obtained by applying the pressure ratio Rp to a flow rate ratio estimation map. The flow rate ratio estimation map is determined in advance, through an experiment and analysis, as a relationship between the pressure ratio Rp and the flow rate ratio Rf. The flow rate ratio estimation map is stored in a ROM or flash memory (both not shown). FIG. 9 is an explanatory diagram showing an example of the flow rate ratio estimation map when the sectional area of the first purge passage 62 and the sectional area of the second purge passage 63 have a certain relationship. As shown in FIG. 9, the flow rate ratio Rf is set so as to become larger within a range being larger than 0 and smaller than 1 as the pressure ratio Rp becomes larger within a range being larger than 0 and smaller than 1. Subsequently, when the sectional areas of the first purge passage 62 and the second purge passage 63 are "S1" and "S2", respectively, with respect to "S1 divided by S2 (S1/S2)" shown in FIG. 9, the flow rate ratio Rf becomes larger (closer to 1) as a value obtained by "S1/S2 becomes larger, that is, as the evaporated fuel is more likely to flow to the first purge passage 62, and the flow rate ratio Rf becomes smaller (closer to 0) as the value obtained by "S1/S2" becomes smaller, that is, the evaporated fuel gas is more unlikely to flow to the first purge passage 62.

When the electronic control unit 70 determines in step S120 that the upstream purge estimation flag Fpup is 0, that is, the electronic control unit 70 estimates that the purge does not include the upstream purge, when the electronic control unit 70 determines in step S130 that the surge pressure Ps is not a negative pressure, or when the electronic control unit 70 determines in step S140 that the ejector pressure Pej is not a negative pressure, the electronic control unit 70 estimates to which the entire evaporated fuel gas that has passed through the purge control valve 65 flows, to the first purge passage 62 or the second purge passage 63, and checks the value of the dominant purge flag Fpd (step S170).

When the dominant purge flag Fpd is 1 in step S170, that is, when the dominant purge is the upstream purge, the electronic control unit 70 estimates that the entire evaporated fuel gas that has passed through the purge control valve 65 flows to the second purge passage 63, sets the flow rate ratio Rf to 0 (step S180), and estimates the first passage flow rate Qp1 and the second passage flow rate Qp2 by executing the processing in steps S200 and S210 described above (step S210).

When the dominant purge flag Fpd is 0 in step S170, that is, when the dominant purge is the downstream purge, the electronic control unit 70 estimates that the entire evaporated fuel gas that has passed through the purge control valve 65 flows to the first purge passage 62, sets the flow rate ratio Rf to 1 (step S190), and estimates the first passage flow rate Qp1 and the second passage flow rate Qp2 by executing the processing in steps S200 and S210 described above (step S210).

When the electronic control unit 70 estimates the first passage flow rate Qp1 and the second passage flow rate Qp2 as described above, the electronic control unit 70 estimates a surge reaching flow rate Qs1 that is a flow rate of the evaporated fuel gas that reaches the surge tank 27 after passing through the purge control valve 65 via the first purge passage 62 and the intake pipe 23 (step S220). Subsequently, the electronic control unit 70 estimates a surge reaching flow rate Qs2 that is a flow rate of the evaporated fuel gas that reaches the surge tank 27 after passing through the purge control valve 65 via the second purge passage 63 and the intake pipe 23 (step S230). The electronic control unit 70 then estimates a sum of the surge reaching flow rate Qs1 and the surge reaching flow rate Qs2 as a surge reaching flow rate Qs that is a flow rate of the evaporated fuel gas that reaches the surge tank 27 (step S240).

Here, the estimation of the surge reaching flow rates Qs1, Qs2 will be described. For ease of explanation, the estimation of the surge reaching flow rate Qs2 and the estimation of the surge reaching flow rate Qs1 will be described in this order. As shown in Equation (1), the surge reaching flow rate Qs2 can be estimated using a surge reaching second flow rate (previous Qs2) estimated last time (previously by an execution interval of the routine), the second passage flow rate Qp2 [Ts2 prior] that is estimated previously by time Ts2, and the number of smoothing τs2. The time Ts2 is a time required for the evaporated fuel gas to reach the surge tank 27 via the second purge passage 63 and the intake pipe 23 after passing through the purge control valve 65. The time Ts2 and the number of smoothing τs2 are set in advance, through an experiment and analysis, based on the engine speed Ne of the engine 12, the load factor KL, and the surge pressure Ps, etc. For example, the time Ts2 and the number of smoothing τs2 are set to be smaller as the engine speed Ne of the engine 12 becomes larger, set to be smaller as the load factor KL becomes larger, and set to be smaller as the surge pressure Ps becomes smaller (larger as a negative pressure). The setting above is based on the fact that a speed of the evaporated fuel gas flowing to the surge tank 27 (the combustion chamber 30) becomes faster as the engine speed Ne of the engine 12 becomes larger, and the load factor KL becomes larger, and the surge pressure Ps becomes smaller. Predetermined constant values may be used as the time Ts2 and the number of smoothing τs2 for simplicity. With the estimation of the surge reaching flow rate Qs2 as described above, the surge reaching flow rate Qs2 can be estimated more appropriately (more accurately) in consideration of the passage volume from the purge control valve 65 to the surge tank 27 via the second purge passage 63 (response delay regarding the flow of the evaporated fuel gas).

$$Qs2=\text{Previous } Qs2+(Qp2[Ts2 \text{ prior}]-\text{Previous } Qs2)/\tau s2 \quad (1)$$

As the surge reaching flow rate Qs1, according to the embodiment, the first passage flow rate Qp1 estimated in step S200 is estimated as the surge reaching flow rate Qs1. With the processing above, the surge reaching flow rate Qs1 can be easily estimated. The method above is particularly useful when the passage volume from the purge control valve 65 to the surge tank 27 via the first purge passage 62 is small enough to ignore the response delay for the flow of the evaporated fuel gas. According to the embodiment, the evaporated fuel processing device 50 (the first purge passage 62) is designed as described above.

At least one of the surge reaching flow rate Qs1, the surge reaching flow rate Qs2, and the surge reaching flow rate Qs is used, for example, in the intake air amount control described above (control of the throttle valve 26).

Subsequently, the electronic control unit 70 estimates a combustion chamber reaching flow rate Qc1 that is a flow rate of the evaporated fuel gas that reaches the combustion chamber 30 after passing through the purge control valve 65 via the first purge passage 62 and the intake pipe 23 (step S250). The electronic control unit 70 then estimates a combustion chamber reaching flow rate Qc2 that is a flow rate of the evaporated fuel gas that reaches the combustion chamber 30 after passing through the purge control valve 65 via the second purge passage 63 and the intake pipe 23 (step S260). The electronic control unit 70 estimates a sum of the combustion chamber reaching flow rate Qc1 and the combustion chamber reaching flow rate Qc2 as a combustion chamber reaching flow rate Qc that is a flow rate of the evaporated fuel gas that reaches the combustion chamber 30 (step S270). The routine then ends.

As shown in Equation (2), the combustion chamber reaching flow rate Qc1 can be calculated using a combustion chamber reaching first flow rate (previous Qc1) estimated last time (previously by the execution interval of the routine), a first passage flow rate Qp1 [Tc1 prior] that is estimated previously by time Tc1, and the number of smoothing τc1. As shown in Equation (3), the combustion chamber reaching flow rate Qc2 can be estimated using a combustion chamber reaching second flow rate (previous Qc2) estimated last time (previously by the execution interval of the routine), the second passage flow rate Qp2 [Tc2 prior] that is estimated previously by time Tc2, and the number of smoothing τc2. The time Tc1 is a time required for the evaporated fuel gas to reach the combustion chamber 30 via the first purge passage 62 and the intake pipe 23 after passing through the purge control valve 65. The time Tc2 is a time required for the evaporated fuel gas to reach the combustion chamber 30 via the second purge passage 63 and the intake pipe 23 after passing through the purge control valve 65. The time Tc2 and the number of smoothing τc2 are set to be larger than the time Tc1 and the number of smoothing τc1. The setting above is based on the fact that the time required for the evaporated fuel gas to reach the combustion chamber 30 via the second purge passage 63 and the intake pipe 23 after passing through the purge control valve 65 is longer than the time required for the evaporated fuel gas to reach the combustion chamber 30 via the first purge passage 62 and the intake pipe 23 after passing through the purge control valve 65. The times Tc1, Tc2 and the numbers of smoothing τc1, τc2 are set in advance through an experiment and analysis based on the engine speed Ne of the engine 12, the load factor KL, and the surge pressure Ps, etc. For example, the times Tc1, Tc2 and the numbers of smoothing τc1, τc2 set to be smaller as the engine speed Ne of the engine 12 becomes larger, to be smaller as the load factor KL becomes larger, and to be smaller as the surge pressure Ps becomes smaller (becomes larger as the negative pressure). This is due to the same reason as the tendency of the time Ts2 and the number of smoothing τs2 described above. Predetermined constant values may be used as the times Tc1, Tc2 and the numbers of smoothing τc1, τc2 for simplicity.

$$Qc1=\text{Previous } Qc1+(Qp1[Tc1 \text{ prior}]-\text{Previous } Qc1)/\tau c1 \quad (2)$$

$$Qc2=\text{Previous } Qc2+(Qp2[Tc2 \text{ prior}]-\text{Previous } Qc2)/\tau c2 \quad (3)$$

The estimation of the combustion chamber reaching flow rates Qc1, Qc2 described above makes it possible to estimate the combustion chamber reaching flow rates Qc1, Qc2 more appropriately (more accurately) in consideration of the passage volume from the purge control valve 65 to the combustion chamber 30 via the first purge passage 62 (response delay regarding the flow of the evaporated fuel gas) and the passage volume from the purge control valve 65 to the combustion chamber 30 via the second purge passage 63 (response delay regarding the flow of the evaporated fuel gas). At least one of the combustion chamber reaching flow rate Qc1, the combustion chamber reaching flow rate Qc2, and the combustion chamber reaching flow rate Qc is used, for example, in the purge control above (control of the purge control valve 65).

Figure 10:
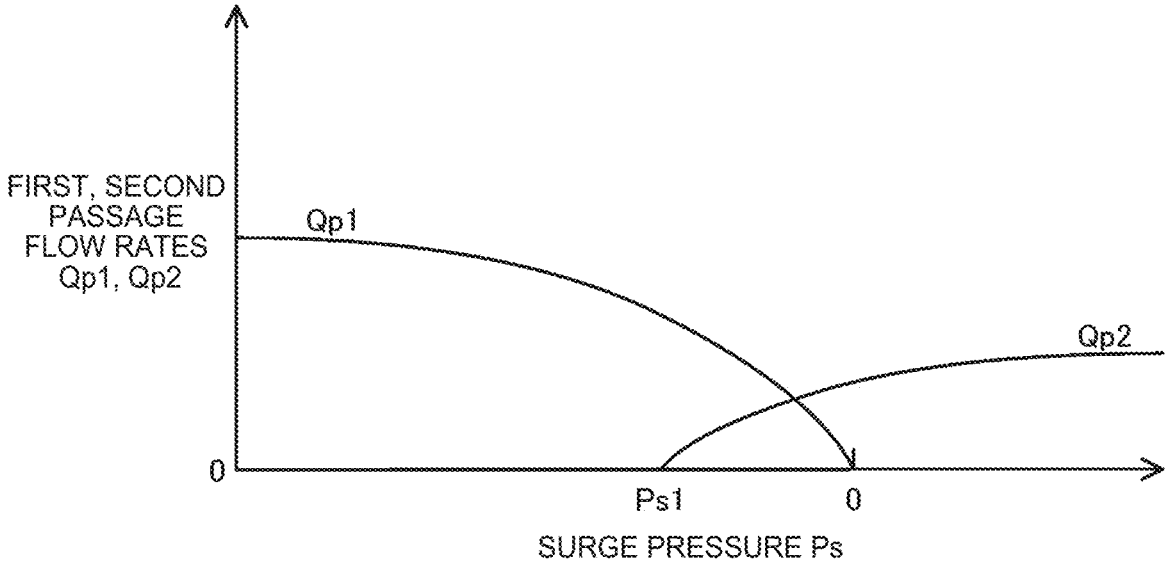
FIG. 10 is an explanatory diagram showing an example of a relationship between the surge pressure Ps, and a first passage flow rate Qp1 and a second passage flow rate Qp2.

FIG. 10 is an explanatory diagram showing an example of the relationship between the surge pressure Ps, and the first passage flow rate Qp1 and the second passage flow rate Qp2. In FIG. 10, a region where the surge pressure Ps is equal to or less than a negative value Ps1 indicates a region where the surge pressure Ps is a negative pressure and the ejector pressure Pej is equal to or more than 0, and a region where the surge pressure Ps is equal to or more than 0 indicates a region where the surge pressure Ps is equal to or more than 0 and the ejector pressure Pej is a negative pressure. Further, a region where the surge pressure Ps is more than the value Ps1 and less than 0 indicates a region where the surge pressure Ps and the ejector pressure Pej are both negative pressures. As shown in FIG. 10, in the region where the surge pressure Ps is equal to or less than the threshold Ps1 (the region where the surge pressure Ps is a negative pressure and the ejector pressure Pej is equal to or more than 0), the entire evaporated fuel gas that has passed through the purge control valve 65 flows into the first purge passage 62. In the region where the surge pressure Ps is equal to or more than 0 (the region where the surge pressure Ps is equal to or more than 0 and the ejector pressure Pej is a negative pressure), the entire evaporated fuel gas that has passed through the purge control valve 65 flows into the second purge passage 63. In the region where the surge pressure Ps is more than the value Ps1 and less than 0 (the region where the surge pressure Ps and the ejector pressure Pej are both negative pressures), the evaporated fuel gas that has passed through the purge control valve 65 (is spontaneously distributed and) flows to the first purge passage 62 and the second purge passage 63. According to the embodiment, when the electronic control unit 70 estimates that the purge includes the upstream purge and the surge pressure Ps and the ejector pressure Pej are both negative pressures, the electronic control unit 70 estimates the flow rate ratio Rf based on the pressure ratio Rp, estimates the first passage flow rate Qp1 based on the valve passing flow rate Qv and the flow rate ratio Rf, and estimates the second passage flow rate Qp2 by subtracting the first passage flow rate Qp1 from the valve passing flow rate Qv. With the processing above, when the evaporated fuel gas flows in the first purge passage 62 and the second purge passage 63, the first passage flow rate Qp1 and the second passage flow rate Qp2 can be estimated more appropriately.

In the engine device 10 according to the embodiment described above, when the upstream purge estimation flag Fpup is 1 (the electronic control unit 70 estimates that the purge includes the upstream purge) and the surge pressure Ps and the ejector pressure Pej are both negative pressures, the electronic control unit 70 estimates the flow rate ratio Rf based on a value obtained by subtracting the offset amount kd from the surge pressure Ps and the ejector pressure Pej, estimates the first passage flow rate Qp1 based on the valve passing flow rate Qv and the flow rate ratio Rf, and estimates the second passage flow rate Qp2 by subtracting the first passage flow rate Qp1 from the valve passing flow rate Qv. With the processing above, when the evaporated fuel gas flows in the first purge passage 62 and the second purge passage 63, the first passage flow rate Qp1 and the second passage flow rate Qp2 can be estimated more appropriately. Moreover, the electronic control unit 70 estimates the flow rate ratio Rf in consideration of the relationship between the sectional area of the first purge passage 62 and the sectional area of the second purge passage 63, the flow rate ratio Rf can be estimated more appropriately.

In the engine device 10 according to the embodiment, when the upstream purge estimation flag Fpup is 1 (the electronic control unit 70 estimates that the purge includes the upstream purge) and the surge pressure Ps and the ejector pressure Pej are both negative pressures, the electronic control unit 70 estimates that the evaporated fuel gas that has passed through the purge control valve 65 flows to the first purge passage 62 and the second purge passage 63. However, when the surge pressure Ps and the ejector pressure Pej are both negative pressures, the electronic control unit 70 may estimate that the evaporated fuel gas that has passed through the purge control valve 65 flows to the first purge passage 62 and the second purge passage 63, without considering the upstream purge estimation flag Fpup.

In the engine device 10 according to the embodiment, when the upstream purge estimation flag Fpup is 1 (the electronic control device 70 estimates that the purge includes the upstream purge) and the surge pressure Ps and the ejector pressure Pej are both negative pressures, the electronic control unit 70 estimates the flow rate ratio Rf based on the pressure ratio Rp and the relationship between the sectional area of the first purge passage 62 and the sectional area of the second purge passage 63. However, the flow rate ratio Rf may be estimated based on the pressure ratio Rp without considering the relationship between the sectional area of the first purge passage 62 and the sectional area of the second purge passage 63.

In the engine device 10 according to the embodiment, the electronic control unit 70 estimates that the first passage flow rate Qp1 as the surge reaching flow rate Qs1. As shown in Equation (4), the electronic control unit 70 may estimate the surge reaching flow rate Qs1 using the surge reaching first flow rate (previous Qs1) estimated last time (previously by the execution interval of the purge flow rate estimation routine in FIG. 3), the first passage flow rate Qp1 [Ts1 prior] estimated previously by the time Ts1, and the number of smoothing τs1. The time Ts1 is the time required for the evaporated fuel gas to reach the surge tank 27 via the first purge passage 62 and the intake pipe 23 after passing through the purge control valve 65. The time Ts1 and the number of smoothing τs1 are set in advance through an experiment and analysis based on the engine speed Ne of the engine 12, the load factor KL, and the surge pressure Ps, etc. For example, the time τs1 and the number of smoothing τs1 are set to be smaller as the engine speed Ne of the engine 12 becomes larger, set to be smaller as the load factor KL becomes larger, and set to be smaller as the surge pressure Ps becomes smaller (larger as a negative pressure). This is due to the same reason as the tendency of the time Ts2 and the number of smoothing τs2 described above. Predetermined constant values may be used as the time Ts1 and the number of smoothing τs1 for simplicity. With the estimation of the surge reaching flow rate Qs1 as described above, the surge reaching flow rate Qs1 can be estimated more appropriately (more accurately) in consideration of the passage volume from the purge control valve 65 to the surge tank 27 via the first purge passage 62 (response delay regarding the flow of the evaporated fuel gas).

$$Qs1=\text{Previous } Qs1+(Qp1[Ts1 \text{ prior}]-\text{Previous } Qs1)/\tau s1 \quad (4)$$

In the engine device 10 according to the embodiment, when the upstream purge estimation flag Fpup is 0 (the electronic control unit 70 estimates that the purge does not include the upstream purge), when the surge pressure Ps is not a negative pressure, or when the ejector pressure Pej is not a negative pressure, the flow rate ratio Rf is set to 0 or 1 based on the dominant purge flag Fpd (whether the dominant purge is the downstream purge or the upstream purge). However, at this time, it is considered that either the surge pressure Ps or the ejector pressure Pej is a negative pressure. Therefore, the flow rate ratio Rf may be set to 0 or 1 based on the surge pressure Ps and/or the ejector pressure Pej, instead of considering the dominant purge flag Fpd.

In the engine device 10 according to the embodiment, the electronic control unit 70 sets the offset amount kd based on the surge pressure Ps, and determines which of the downstream purge and the upstream purge is the dominant purge based on the ejector pressure Pej and the value obtained by subtracting the offset amount kd from the surge pressure Ps. However, the electronic control unit 70 may determine which of the downstream purge and the upstream purge is the dominant purge based on the ejector pressure Pej and a value obtained by subtracting a constant offset amount kd irrelevant to the surge pressure Ps from the surge pressure Ps. Further, the electronic control unit 70 may determine which of the downstream purge and the upstream purge is the dominant purge based on the ejector pressure Pej and the surge pressure Ps (a value without subtraction of the offset amount kd).

In the engine device 10 according to the embodiment, the engine 12 includes the in-cylinder injection valve 28 that injects the fuel into the combustion chamber 30. However, in addition to or in place of the in-cylinder injection valve 28, the engine 12 may include a port injection valve that injects the fuel into the intake port.

In the engine device 10 according to the embodiment, the supercharger 40 is configured as a turbocharger in which the compressor 41 disposed in the intake pipe 23 and the turbine 42 disposed in the exhaust pipe 35 are connected via the rotary shaft 43. However, instead of this, the supercharger 40 may be configured as a supercharger in which a compressor that is driven by the engine 12 or the motor is disposed in the intake pipe 23.

In the engine device 10 according to the embodiment, in the evaporated fuel processing device 50, the common passage 61 is connected to the introduction passage 52 in the vicinity of the canister 56. However, the common passage 61 may be connected to the canister 56.

According to the embodiment, the engine device 10 is mounted on a general automobile or various types of hybrid automobiles. However, the engine device 10 may be mounted in vehicles other than automobiles, and may be mounted in unmovable facilities such as construction facilities.

The correspondence relationship between the main elements of the embodiment and the main elements of the present disclosure described in the summary will be described. According to the embodiment, the engine 12 corresponds to an "engine", the supercharger 40 corresponds to a "supercharger", the evaporated fuel processing device 50 corresponds to an "evaporated fuel processing device", and the electronic control unit 70 corresponds to a "control device".

The correspondence between the main elements of the embodiment and the main elements of the present disclosure described in the summary is an example for specifically describing a mode for carrying out the present disclosure described in the summary Therefore, the embodiment does not limit the elements of the present disclosure described in the summary That is, the interpretation of the present disclosure described in the summary should be carried out based on the description in the summary, and the embodiment is merely a specific example of the present disclosure described in the summary.

Although the mode for carrying out the present disclosure has been described above with reference to the embodiment, an applicable embodiment of the present disclosure is not limited to the embodiment, and the present disclosure may be carried out in various modes without departing from the gist of the present disclosure.

The present disclosure can be used in, for example, the manufacturing industry of the engine device.

What is claimed is:

1. An engine device, comprising:

an engine that includes a throttle valve disposed in an intake pipe and outputs power through explosive combustion in a combustion chamber using a fuel supplied from a fuel tank;

a supercharger including a compressor disposed on an upstream side of the intake pipe with respect to the throttle valve;

an evaporated fuel processing device including a supply passage that branches into a first purge passage connecting to a downstream side of the intake pipe with respect to the throttle valve and a second purge passage and supplies an evaporated fuel gas containing an evaporated fuel generated in the fuel tank to the intake pipe via the first purge passage and the second purge passage, an ejector having an intake port connecting to a return passage connecting to the intake pipe between the compressor and the throttle valve, an exhaust port connecting to an upstream side of the intake pipe with respect to the compressor, and a suction port connecting to the second purge passage, and a purge control valve provided in the supply passage; and an electronic control device, wherein when a predetermined condition that the evaporated fuel gas that passes through the purge control valve flows to the first purge passage and the second purge passage is satisfied, the electronic control device estimates a flow rate ratio of a first passage flow rate to a second passage flow rate based on a relationship between a throttle post pressure being a pressure on the downstream side of the intake pipe with respect to the throttle valve and an ejector pressure being a pressure of the suction port of the ejector, the first passage flow rate being a flow rate of the evaporated fuel gas flowing in the first purge passage and the second passage flow rate being a flow rate of the evaporated fuel gas flowing in the second purge passage, and estimates the first passage flow rate and the second passage flow rate based on the flow rate ratio and a valve passing flow rate being a flow rate of the evaporated fuel gas that passes through the purge control valve, and wherein the electronic control device uses the estimated first passage flow rate and the estimated second passage flow rate to control an opening degree of the purge control valve.

2. The engine device according to claim 1, wherein when the predetermined condition is satisfied, the electronic control device estimates the flow rate ratio based on the relationship between the throttle post pressure and the ejector pressure and a relationship between a sectional area of the first purge passage and a sectional area of the second purge passage.

3. The engine device according to claim 1, wherein the predetermined condition includes a condition in which the throttle post pressure and the ejector pressure are negative pressures.

4. The engine device according to claim 3, wherein:

in estimation processing in which, when the throttle post pressure is less than a threshold, the electronic control device estimates a purge that supplies the evaporated fuel gas to the intake pipe does not include a second purge that supplies the evaporated fuel gas to the intake pipe via the second purge passage, and when the throttle post pressure is equal to or more than the threshold, the electronic control device estimates that the purge includes the second purge, the electronic control device continues the estimation that the purge includes the second purge until a predetermined time elapses when the throttle post pressure falls below the threshold from a state of being equal to or more than the threshold; and the predetermined condition further includes a condition in which the electronic control device estimates that the purge includes the second purge.

5. The engine device according to claim 1, wherein:

the electronic control device determines which of a first purge and a second purge is a dominant purge based on the ejector pressure and the throttle post pressure, the first purge supplying the evaporated fuel gas to the intake pipe via the first purge passage and the second purge supplying the evaporated fuel gas to the intake pipe via the second purge passage; and the electronic control device further estimates the flow rate ratio based on the dominant purge when the predetermined condition is not satisfied.

* * * * *